US009906853B2

(12) United States Patent
Kristo et al.

(10) Patent No.: US 9,906,853 B2
(45) Date of Patent: Feb. 27, 2018

(54) BONE CONDUCTION DEVICE SUPPORT

(71) Applicant: Cochlear Limited, Macquarie University, NSW (AU)

(72) Inventors: Stefan Kristo, Gothenburg (SE); Helena Pruss Cindric, Gothenburg (SE); Henrik Jeppesen, Holte (DK); Martin Práme, Svedala (SE); Mark Flynn, Gothenburg (SE)

(73) Assignee: Cochlear Limited, Macquarie University, NSW (AU)

( * ) Notice: Subject to any disclaimer, the term of this patent is extended or adjusted under 35 U.S.C. 154(b) by 233 days.

(21) Appl. No.: 14/627,626

(22) Filed: Feb. 20, 2015

(65) Prior Publication Data

US 2015/0163579 A1 Jun. 11, 2015

Related U.S. Application Data

(63) Continuation of application No. 13/270,735, filed on Oct. 11, 2011, now abandoned.

(51) Int. Cl.

| | |
|---|---|
| ***H04R 25/00*** | (2006.01) |
| ***H04R 1/10*** | (2006.01) |
| ***H04R 1/46*** | (2006.01) |

(52) U.S. Cl.

CPC ..... *H04R 1/105* (2013.01); *H04R 1/46* (2013.01); *H04R 25/00* (2013.01); *H04R 25/606* (2013.01); *H04R 1/1075* (2013.01); *H04R 25/554* (2013.01); *H04R 2460/13* (2013.01)

(58) Field of Classification Search

CPC ..... H04R 1/105; H04R 1/46; H04R 1/1075; H04R 25/00; H04R 25/606; H04R 25/554; H04R 2460/13; H04R 2225/67; A61N 1/36032; A61F 2002/183; A61F 2/18

USPC ..... 381/322, 326, 380, 312, 314, 324, 151

See application file for complete search history.

(56) References Cited

U.S. PATENT DOCUMENTS

| | | | | |
|---|---|---|---|---|
| 2,891,116 A | | 3/1955 | Nichols | |
| 4,039,765 A | | 8/1977 | Tichy et al. | |
| 4,606,329 A | * | 8/1986 | Hough | A61N 1/36032 381/326 |

(Continued)

FOREIGN PATENT DOCUMENTS

| | | | | |
|---|---|---|---|---|
| JP | 2006-148295 A | | 6/2006 | |
| JP | 2007-312050 | * | 11/2007 | H01R 1/00 |

(Continued)

OTHER PUBLICATIONS

Supplemental European Search Report for EP Application No. 12839515.9 dated Mar. 26, 2015.

(Continued)

*Primary Examiner* — Md S Elahee
*Assistant Examiner* — Sabrina Diaz
(74) *Attorney, Agent, or Firm* — Hauptman Ham, LLP; Martin J. Cosenza

(57) ABSTRACT

A prosthetic support, including a structure configured to apply a clamping force to a head of a recipient while extending about a back of at least one of a head or neck of the recipient such that output generated by a device supported by the structure is directed into skin of the recipient at a location behind an ear canal of the recipient that covers the mastoid bone of the recipient.

42 Claims, 11 Drawing Sheets

(56) References Cited

U.S. PATENT DOCUMENTS

| | | | | |
|---|---|---|---|---|
| 5,457,751 | A * | 10/1995 | Such | H04M 1/05 348/115 |
| 5,988,812 | A | 11/1999 | Wingate | |
| 7,076,077 | B2 * | 7/2006 | Atsumi | H04R 1/1066 381/151 |
| 7,394,912 | B2 | 7/2008 | Whipple | |
| 7,822,215 | B2 | 10/2010 | Carazo et al. | |
| 2002/0120332 | A1 | 8/2002 | Law et al. | |
| 2007/0041595 | A1 | 2/2007 | Carazo et al. | |
| 2007/0160251 | A1 | 7/2007 | Gabriel | |
| 2009/0185699 | A1 | 7/2009 | Kim | |
| 2010/0092021 | A1 * | 4/2010 | Wiskerke | H04R 1/08 381/364 |
| 2012/0302822 | A1 | 11/2012 | Van Himbeeck et al. | |
| 2013/0089229 | A1 | 4/2013 | Kristo et al. | |

FOREIGN PATENT DOCUMENTS

| | | | |
|---|---|---|---|
| JP | 2007-312050 | A | 11/2007 |
| KR | 10-0488651 | A | 5/2005 |
| WO | 2008/004274 | A1 | 1/2008 |

OTHER PUBLICATIONS

International Search Report for International Application No. PCT/IB2012/055524 dated Mar. 8, 2013.
Written Opinion of the International Searching Authority for International Application No. PCT/IB2012/055524 dated Mar. 8, 2013.
International Preliminary Report on Patentability for International Application No. PCT/IB2012/055524 dated Apr. 15, 2014.

* cited by examiner

BONE CONDUCTION DEVICE SUPPORT

The present application is a Continuation application of U.S. patent application Ser. No. 13/270,735, filed Oct. 11, 2011, naming Stefan Kristo as an inventor, the entire contents of that application being incorporated herein by reference in its entirety.

BACKGROUND

Field of the Invention

The present invention relates generally to hearing prostheses and, more particularly, to a support for bone conduction hearing prostheses.

Related Art

For persons who cannot benefit from traditional acoustic hearing aids, there are other types of commercially available hearing prostheses such as, for example, bone conduction hearing prostheses (commonly referred to as "bone conduction devices"). Bone conduction devices mechanically transmit sound information to a recipient's cochlea by transferring vibrations to a person's skull. This enables the hearing prosthesis to be effective regardless of whether there is disease or damage in the middle ear.

Traditionally, bone conduction devices transfer vibrations from an external vibrator to the skull through a bone conduction implant that penetrates the skin and is physically attached to both the vibrator and the skull. Typically, the external vibrator is connected to the percutaneous bone conduction implant located behind the outer ear facilitating the efficient transfer of sound via the skull to the cochlea. The bone conduction implant connecting the vibrator to the skull generally comprises two components: a bone attachment piece (e.g., bone fixture/fixture) that is attached or implanted directly to the skull, and a skin penetrating piece attached to the bone attachment piece, commonly referred to as an abutment.

SUMMARY

In one aspect of the present invention, there is a prosthetic support, comprising a structure configured to apply a clamping force to a head of a recipient while extending about a back of at least one of a head or neck of the recipient such that output generated by a device supported by the structure is directed into skin of the recipient at a location behind an ear canal of the recipient that covers the mastoid bone of the recipient.

In another aspect of the present invention, there is a headset for a bone conduction device, comprising a headset configured to support at least one bone conduction device and configured provide a clamping force reactive against a head of the recipient sufficient to transmit vibrations from the bone conduction device into skin of the recipient at a location where the skin covers the mastoid bone behind an ear canal of the recipient, wherein the headset is configured such that a center of gravity of the headset, during normal use, is located behind and, with respect to a vertical direction, at least one of about level with or below the location.

In another aspect of the present invention, there is a hearing prosthesis, comprising a bone conduction device; and means for supporting the bone conduction device such that vibrations from the bone conduction device are transferred into skin of a recipient of the bone conduction device covering the mastoid bone at a location behind an ear canal of the recipient, wherein the means is completely external to the recipient.

BRIEF DESCRIPTION OF THE DRAWINGS

Embodiments of the present invention are described herein with reference to the attached drawing sheets in which.

7B depicts an alternate embodiment of a support in which structure providing a clamping force on the recipient includes a substructure that articulates relative to another substructure.

DETAILED DESCRIPTION

In an exemplary embodiment, there is a prosthetic support, such as a support for a bone conduction device. The support is configured to apply a clamping force to a head of a recipient while extending about a back of at least one of a head or neck of the recipient. The clamping force is sufficient to permit, in the case of a support for a bone conduction device, vibrations generated by the bone conduction device to be directed into skin of the recipient at a location behind an ear canal of the recipient covering the mastoid bone of the recipient to stimulate the cochlea of the recipient, thereby providing a hearing percept.

In an exemplary embodiment, the structure of the support is in the form of a resiliently flexible arch that extends from one side of the recipient's head to the other side of the recipient's head. The resilient nature of the arch provides the clamping force when the head of the recipient is interposed inside the arch. The clamping force is sufficient to hold the arch in place without a component that extends in front of the head of the recipient and/or a component that extends above the top of the recipient.

In an exemplary embodiment, the support is configured to enable one or more bone conduction devices to removably snap couple to the support, thus permitting the support to be utilized with existing bone conduction devices (such as, for example, percutaneous bone conduction devices that utilize a snap-couple feature). Further, the support may be adjusted without the use of tools so as to adjust a location of a skin interface portion of the support.

Additional details of the support are provided below, but first, a brief discussion of an exemplary bone conduction device with which some exemplary supports may be utilized will now be provided.

Figure 1:
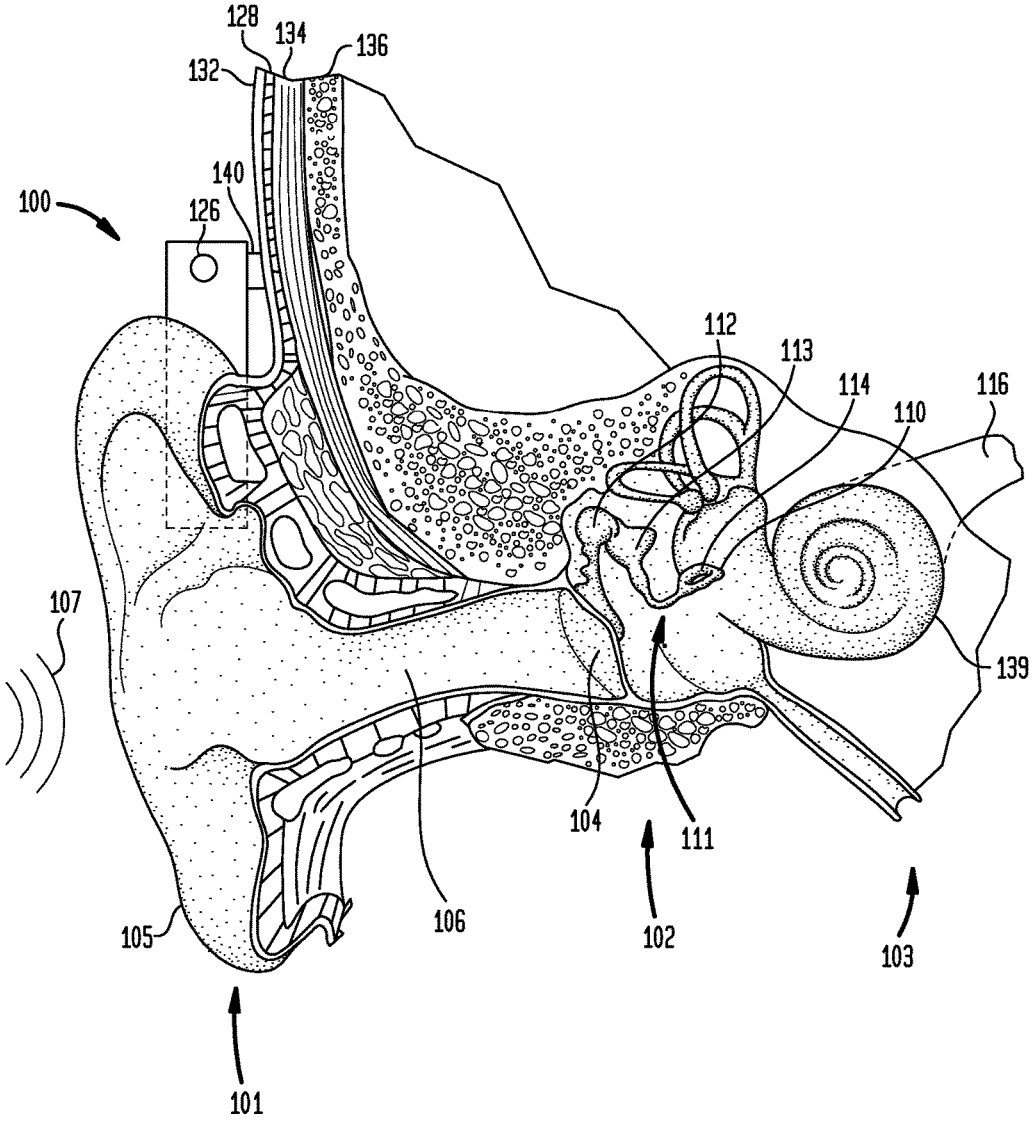
FIG. 1 is a perspective view of a percutaneous bone conduction device with which embodiments may be used.

FIG. 1 is a perspective view of a bone conduction device 100 in which embodiments of the present invention may be implemented. As shown, the recipient has an outer ear 101, a middle ear 102 and an inner ear 103. Elements of outer ear 101, middle ear 102 and inner ear 103 are described below, followed by a description of bone conduction device 100.

In a fully functional human hearing anatomy, outer ear 101 comprises an auricle 105 and an ear canal 106. A sound wave or acoustic pressure 107 is collected by auricle 105 and channeled into and through ear canal 106. Disposed across the distal end of ear canal 106 is a tympanic membrane 104 which vibrates in response to acoustic wave 107. This vibration is coupled to oval window or fenestra ovalis 210 through three bones of middle ear 102, collectively referred to as the ossicles 111 and comprising the malleus 112, the incus 113 and the stapes 114. The ossicles 111 of middle ear 102 serve to filter and amplify acoustic wave 107, causing oval window 210 to vibrate. Such vibration sets up waves of fluid motion within cochlea 139. Such fluid motion, in turn, activates hair cells (not shown) that line the inside of cochlea 139. Activation of the hair cells causes appropriate nerve impulses to be transferred through the spiral ganglion cells and auditory nerve 116 to the brain (not shown), where they are perceived as sound.

FIG. 1 also illustrates the positioning of bone conduction device 100 relative to outer ear 101, middle ear 102 and inner ear 103 of a recipient of device 100. As shown, bone conduction device 100 is positioned behind outer ear 101 of the recipient and comprises a sound input element 126 to receive sound signals. Sound input element may comprise, for example, a microphone, telecoil, etc. In an exemplary embodiment, sound input element 126 may be located, for example, on or in bone conduction device 100, or on a cable extending from bone conduction device 100.

In an exemplary embodiment, bone conduction device 100 comprises an operationally removable component removably attached to a bone conduction implant. By operationally removably attaches, it is meant that it is removable in such a manner that the recipient can relatively easily attach and remove the operationally removable component during normal use of the bone conduction device 100. This as contrasted with how the bone conduction implant is attached to the skull, which is attached via a bone screw. The bone conduction device includes a sound processor (not shown), a vibrating electromagnetic actuator (not shown) and/or various other operational components, such as sound input device 126. More particularly, sound input device 126 (e.g., a microphone) converts received sound signals into electrical signals. These electrical signals are processed by the sound processor. The sound processor generates control signals which cause the actuator to vibrate. In other words, the actuator converts the electrical signals into mechanical motion to impart vibrations to the recipient's skull.

As illustrated, bone conduction device 100 further includes a coupling apparatus 140 configured to operationally removably attach the bone conduction device to a bone conduction implant (also referred to as an anchor system and/or a fixation system) which is implanted in the recipient. In the embodiment of FIG. 1, coupling apparatus 140 is coupled to the bone conduction implant (not shown) implanted in the recipient. Briefly, an exemplary bone conduction implant may include a percutaneous abutment attached to a bone fixture via a screw, the bone fixture being fixed to the recipient's skull bone 136. The abutment extends from the bone fixture which is screwed into bone 136, through muscle 134, fat 128 and skin 232 so that coupling apparatus 140 may be attached thereto. Such a percutaneous abutment provides an attachment location for coupling apparatus 140 that facilitates efficient transmission of mechanical force.

Figure 2:
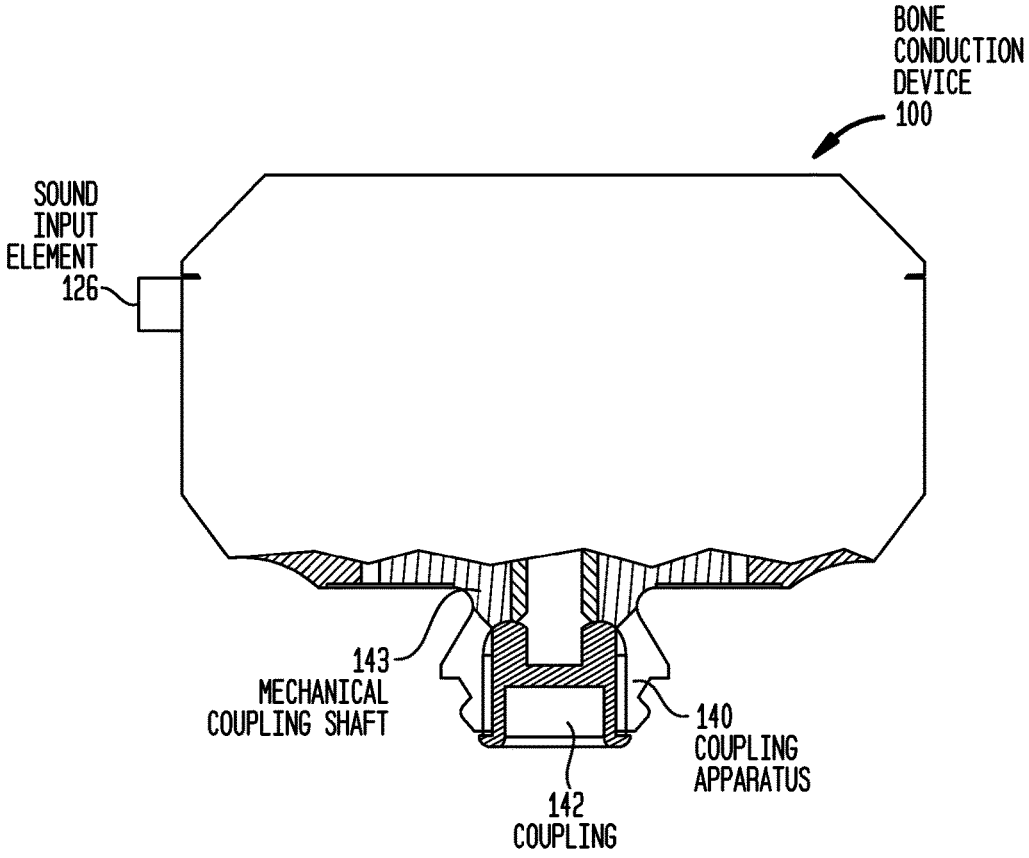
FIG. 2 depicts a side view and a cross-sectional view of a bone conduction device used with an exemplary embodiment.

FIG. 2 depicts additional details of an exemplary embodiment of a bone conduction device 100 usable with at least some embodiments as detailed herein and variations thereof. Particularly, bone conduction device 100 is a percutaneous bone conduction device that includes a coupling apparatus 140 configured to attach the bone conduction device 100 to an abutment connected to a bone fixture implanted in the recipient. As illustrated, the coupling apparatus 140 includes a coupling 142 in the form of a snap coupling configured to "snap couple" to a bone fixture system on the recipient.

In an embodiment, the coupling 142 corresponds to the coupling described in U.S. patent application Ser. No. 12/177,091 assigned to Cochlear Limited. In an alternate embodiment, a snap coupling such as that described in U.S. patent application Ser. No. 12/167,796 assigned to Cochlear Limited is used. In yet a further alternate embodiment, a magnetic coupling such as that described in U.S. patent application Ser. No. 12/167,851 assigned to Cochlear Limited is used instead of or in addition to coupling 241 or the snap coupling of U.S. patent application Ser. No. 12/167,796.

The coupling apparatus 140 is mechanically coupled, via mechanical coupling shaft 143, to a vibrating actuator (not shown) within the bone conduction device 100. In an exemplary embodiment, the vibrating actuator is a device that converts electrical signals into vibration. In operation, sound input element 126 converts sound into electrical signals. Specifically, the bone conduction device provides these electrical signals to the vibrating actuator, or to a sound processor that processes the electrical signals, and then provides those processed signals to a vibrating actuator. The vibrating actuator converts the electrical signals (processed or unprocessed) into vibrations. Because vibrating actuator is mechanically coupled to coupling apparatus 140, the vibrations are transferred from the vibrating actuator to the coupling apparatus 140 and then to the recipient via the bone fixture system (not shown).

Figure 3A:
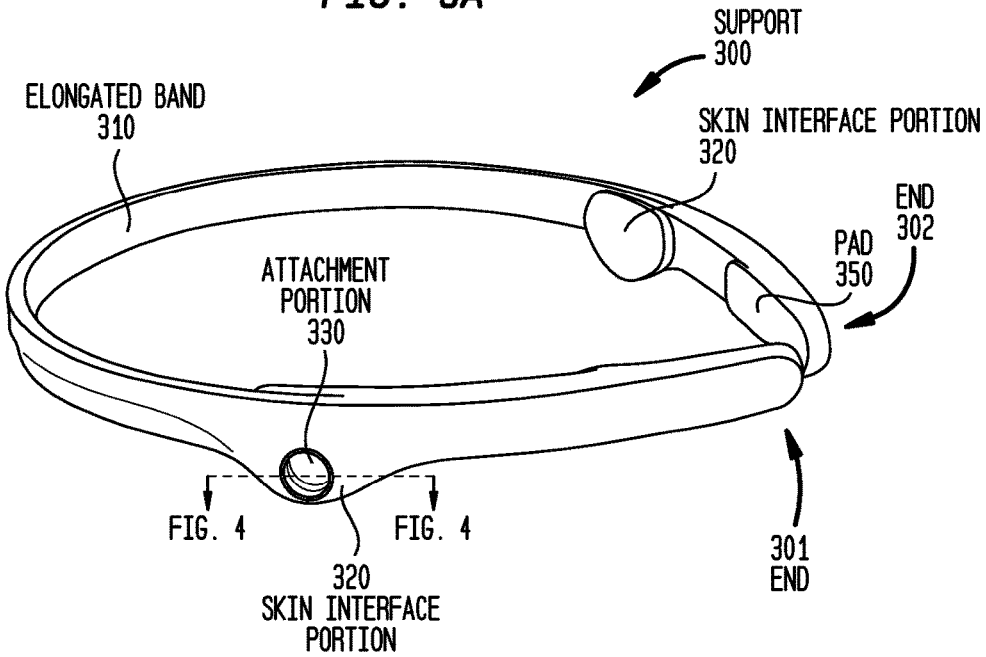
FIG. 3A depicts an isometric view of a support according to an exemplary embodiment.

FIG. 3A depicts an exemplary embodiment of a bone conduction device support 300. It is noted that while most embodiments detailed herein will be described in terms of a bone conduction device support, other embodiments include a support for other types of medical devices. Such exemplary medical device supports may include, for example, a support for an external component of a cochlear implant, a support for an external component for a middle ear implant, etc., examples of some of these being described in further detail below. Still further, some embodiments are directed towards prosthetic supports used to support luxury and/or functional devices where there is no medical necessity for such devices (e.g., bone conduction devices used as an alternate method of stimulating the cochlea in a person with normal hearing capability).

While the just-mentioned examples are described in terms of hearing prostheses, it is noted that other medical device supports consistent with the teachings herein and variations thereof may be practiced to support other types of medical devices or other devices other than hearing prosthesis components.

Figure 3B:
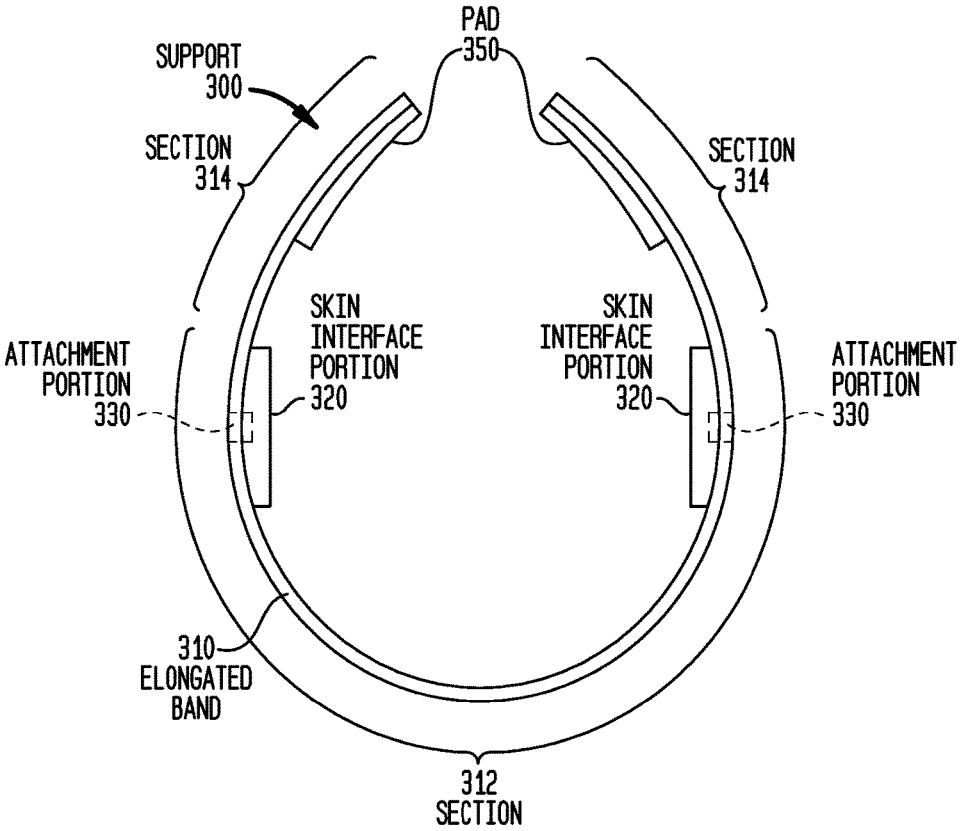
FIG. 3B depicts a top view of the support depicted in FIG. 3A.

Referring to FIGS. 3A and 3B, bone conduction device support 300 includes a structure 310 that is generally circular shaped and is segmented at one location. Bone conduction device support 300 includes an elongated structure 310 in a form that is resiliently flexible such that the outer diameter of the generally circular shaped structure 310 may be resiliently expanded from that depicted in FIGS. 3A and 3B/ends 301 and 302 may be moved away from each other from the location depicted in FIGS. 3A and 3B. That is, the configuration of the elongated structure 310 depicted in FIGS. 3A and 3B depicts the elongated structure 310 in a relaxed state where no exterior forces are applied to the elongated structure 310, such as the force applied thereto by the head of a recipient. In this regard, bone conduction device support 300 is configured to be placed around a portion of a head of a recipient 3000 as may be seen in FIG. 3C. Elongated structure 310 corresponds to structure that is flexibly biased such that a clamping force results on the recipient's head in reaction to the deformation of the elongated structure outward (i.e., expanded outer diameter) due to interference of the elongated structure 310 with the head of the recipient relative to the geometry of the elongated structure 310 in a relaxed state. In an exemplary embodiment, elongated structure 310 is constructed, arranged and dimensioned such that it will apply a sufficient clamping force to the head of a recipient such that the support 300 will be retained to the head of the recipient to permit efficacious functionality of the device supported by the support, as will be further detailed below.

In an exemplary embodiment, the structure is configured to apply a clamping force, where such force may vary with head size, with the force being greater when used with heads of larger size owing to the greater deformation of the structure (for supports of the same design used on different heads). Additional specifics of ergonomic/human factors features pertaining to variations in head size of recipients are discussed in greater detail below.

Elongated structure 310 corresponds to structure that may be made entirely out of a material that is elastically deformable in a manner sufficient to practice embodiments detailed herein and variations thereof. In yet other embodiments, elongated structure 310 may be made out of metal such as aluminum, flexible steel (e.g., spring steel), or other types of metals and/or metal alloys and/or non-metals that will permit the elongated structure 310 to elastically deform in accordance with embodiments detailed herein and variations thereof. In yet other embodiments, the elongated structure 310 may be a composite structure made of metal strands encased in plastic or rubber or some other material that will provide the requisite elastic deformations and/or ergonomic features. Any type of material may be used to form the elongated structure 310 providing the embodiments detailed herein and variations thereof may be practiced.

As noted above and may be seen in FIGS. 3A and 3B, elongated structure 310 is in the general shape of a segmented circle when the elongated structure 310 is in a relaxed state (e.g., when no head of a recipient is interposed inside the elongated structure 310). When a head of a recipient is interposed inside elongated structure 310/interposed between the ends 301 and 302 of the elongated structure 310, the elongated structure 310 deforms from the generally segmented circle shape of its relaxed state to a "C" shape or a "U" shape. It is noted that when the elongated structure 310 is referred to in the relaxed state, the relaxed state includes a state where ends 301 and 302 are contacting each other, thus preventing the elongated structure 310 from elastically deforming further inward (i.e., the overall outside diameter of the elongated structure 310 would decrease more but for contact between the ends of the elongated structure 310). Accordingly as used herein, the phrase relaxed state refers to the state of the elongated structure 310 when there is no other object that is not part of the bone conduction device support 300 interposed inside elongated structure 310/in between ends 301 and 302 of elongated structure 310.

While the Elongated structure 310 of FIGS. 3A and 3B have been depicted and described in terms of a structure that forms a segmented circle when in the relaxed state, other embodiments may utilize a structure that is generally "C" shaped or generally "U" shaped when the elongated structure 310 is the in the relaxed state. Any size or shape of an elongated structure 310 may be used in some embodiments providing that such an elongated structure will enable the embodiments detailed herein and variations thereof to be practiced. Indeed, in other embodiments, other types of structure other than an elongated structure may be utilized. In this regard, structure corresponding to, for example, a partial helmet (such as a helmet that only covers a back of a head), a full helmet (e.g., U.S. football helmet, bicycle helmet, war fighter helmet, etc.) may be utilized as structure for a medical device support. Any type of structure that provides the clamping capabilities and/or adjustment capabilities detailed herein and variations thereof and permits the medical device supported thereby to have efficacy may be used in some embodiments.

Figure 3C:
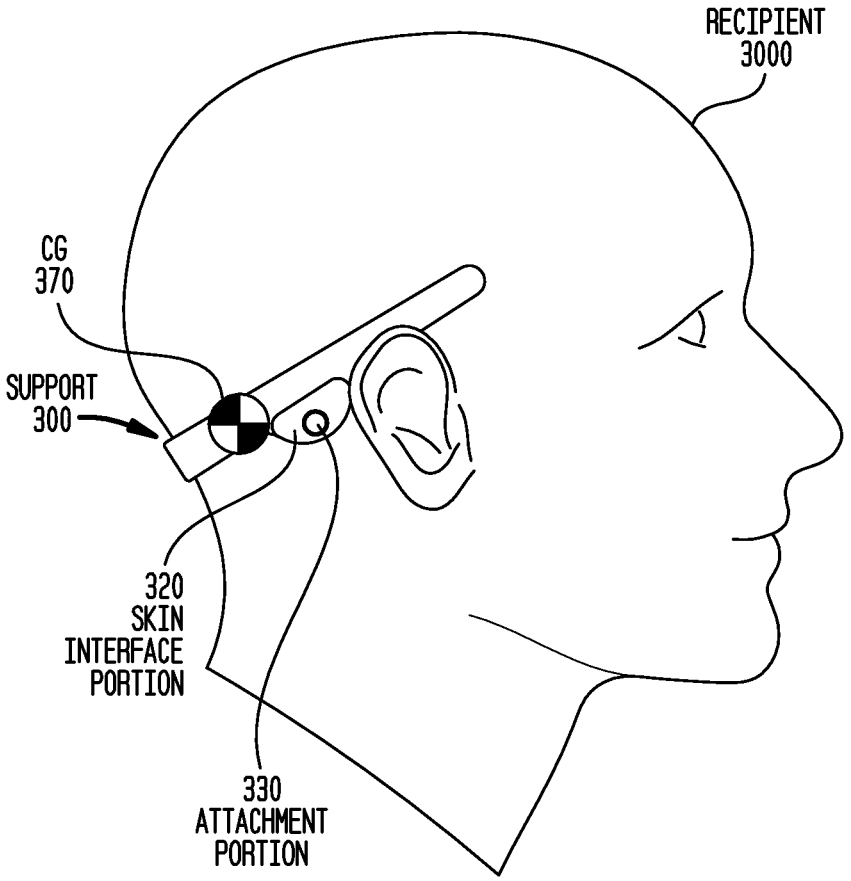
FIG. 3C depicts the support of FIGS. 3A and 3B worn as intended on a recipient.

From FIGS. 3A-3C, it can be seen that the embodiments of the support 300 depicted therein correspond to an embodiment that utilizes an elongated structure 310 that substantially extends parallel to a plane. However, in other embodiments, structure 310 may extend in a varying matter. By way of example and not by way of limitation, support 300 may extend downwards in front of the ear of the recipient. That is, instead of extending parallel to a plane to which the rest of the structure 310 extends in a parallel manner, the portions of structure 310 making up sections 314 may extend downward, or alternatively, upward, or may extend in both directions. In an alternate embodiment, the mid-portions of structure 310 (e.g., those portions which would be located in the back when placed on recipient 3000) may extend downward such that a portion of the structure 310 rests on the location of the recipient at or between the shoulders and the beginning of the neck of the recipient 3000, thereby providing some additional support in the vertical direction against gravity and/or downward vertical acceleration for the support 300. Any configuration of structure 310 may be used in some embodiments providing that the embodiments detailed herein and variations thereof may be practiced.

With reference to FIGS. 3B and 3C, it will be seen that support 300 includes section 312 that corresponds to portions of the support 300 that are located, for at least the most part, behind the ear canal of the recipient 3000 when the support 300 is worn by the recipient (where 'behind' is with reference to the vertical direction when the recipient is looking directly forward). Further, support 300 includes section 314 that corresponds to portions of the support 300 that are located, for at least the most part, in front of the ear canal of the recipient 3000 when the support 300 is worn by the recipient (where 'in front' is with reference to the vertical direction when the recipient is looking directly forward). Sections 314 include the foam pad 350, as may be seen. It is noted that in other embodiments, the structure 310 may stop at or about at the ends of section 312. That is, some embodiments of the support 300 may not have sections 314 that extend in front of the ear canal of the recipient 3000. Further, in embodiments that have sections 314, these sections may not extend as far in front of the ear canal of the recipient 3000 as depicted in the FIGS., while in other embodiments, section 314 may extend even further in front of the ear canal than that depicted in the FIGS.

It is noted that in the embodiments depicted herein, the elongated structure is depicted as a structure that extends from one side of the support to the other side of the support, in other embodiments, the elongated structure 310 may extend only a portion of the way about the support, where another structure having a different configuration or even the same configuration may be connected to structure 310, this alternate structure extending away from structure 310.

Support 300 includes skin interface portions 320. A portion or all of skin interface portions 320 may be part of the structure of elongated structure 310 (e.g., monolithic therewith) or may be a component that is attached to the structure of the elongated structure 310 (that is, skin interface portions 320 may be separate components mechanically attached to the elongated structure), or may be a combination thereof. Skin interface portions 320 are located at positions on support 300 and configured such that the inner surfaces of the skin interface portions 320 abut skin of the recipient at a location behind the ear canal of the recipient where the skin covers the mastoid bone of the recipient. This may be seen in FIG. 3C, which depicts placement of the support 300 about the head of a recipient 3000 so as to enable one or more bone conduction devices (not shown) supported by the support to provide a hearing percept to the recipient 3000 as will be detailed further below.

Still with reference to the skin interface portions 320, in the embodiment depicted in FIGS. 3A and 3B, a substantial amount (including all) of the aforementioned clamping force that results from the structure of the elongated structure 310 due to interference of the structure 310 with the head of a recipient is applied through the skin interface portions 320. It is noted that in some embodiments, there may be ancillary contact between other parts of support 300/other parts of elongated structure 310 and the head and/or body of the recipient, as will be described below. That is, the fact that the clamping force applied to the head of the recipient is applied substantially through the skin interface portion does not exclude ancillary contact and even ancillary clamping force applied by other portions of the support 300. In this regard, the exemplary embodiment of the support 300 depicted in FIGS. 3A and 3B includes pads 350 located at ends 301 and 302 of the elongated structure 310. Pads 350 may be made of foam, silicone, or other type of material that cushions or otherwise provides an ergonomic interface between the support 300 and the skin of the head of the recipient. In some embodiments, some clamping force applied by the support 300 to the head is transferred through the foam pads 350, while in other embodiments, the pads 350 primarily are utilized to provide an additional area of friction between the skin of the recipient and the support so as to provide a reaction against, for example, downward movements of the support. Indeed, in some embodiments, pads 350 provide additional stability to the support 300 relative to the head of the recipient.

Figure 4:
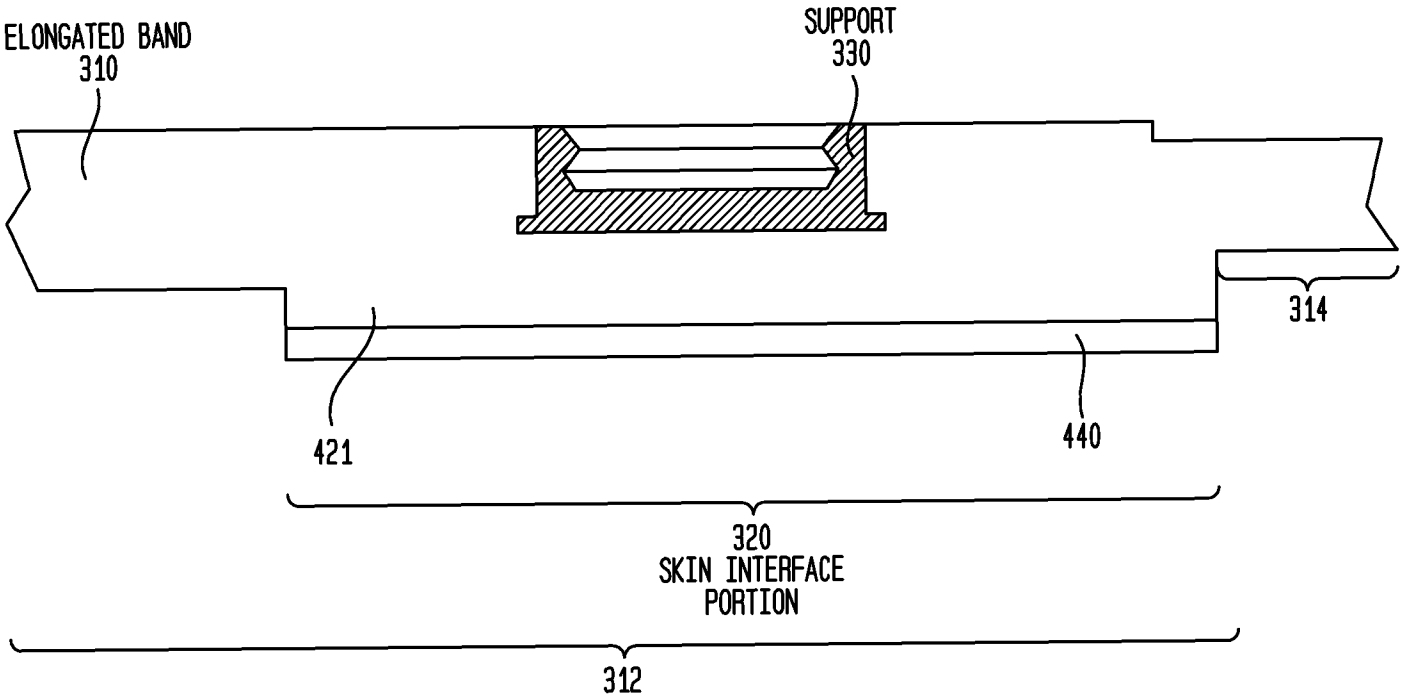
FIG. 4 depicts a cross-sectional view of a skin interface portion of the embodiment of FIG. 3A.

Referring to FIG. 4, which depicts a cross section taken through skin interface portion 320 of support 300, with reference to the cross-sectional indication depicted in FIG. 3A, it can be seen that skin interface portion 320 includes a portion 421 that extends from the general profile of elongated structure 310. Skin interface portion includes an adhesive 440 that enhances adherence of the skin interface portion 320 to the skin of the recipient at a location behind the ear canal of the recipient 3000. In this regard, FIG. 4 depicts an exemplary embodiment where a portion of skin interface portion is monolithic with structure 310 and a portion (adhesive 440) that is attached to structure 310. It is noted that in some embodiments, adhesive 440 is not present in the skin interface portion and/or is located at other locations (e.g. at ends 301 and 302 of the elongated structure 310). Also, in some embodiments, adhesive 440 may be covered with a seal or the like that is removable to expose the adhesive just prior to use. It is noted that a pad may be positioned over adhesive 440 where the adhesive is used to adhere the pad to the elongated structure 310 and/or element 440 may be a pad that is mechanically connected to elongated structure 310. Such a pad may not include adhesive on the skin side. Note further that element 440 may be a pad molded to elongated structure 310 and/or part of elongated structure 310.

Figure 5:
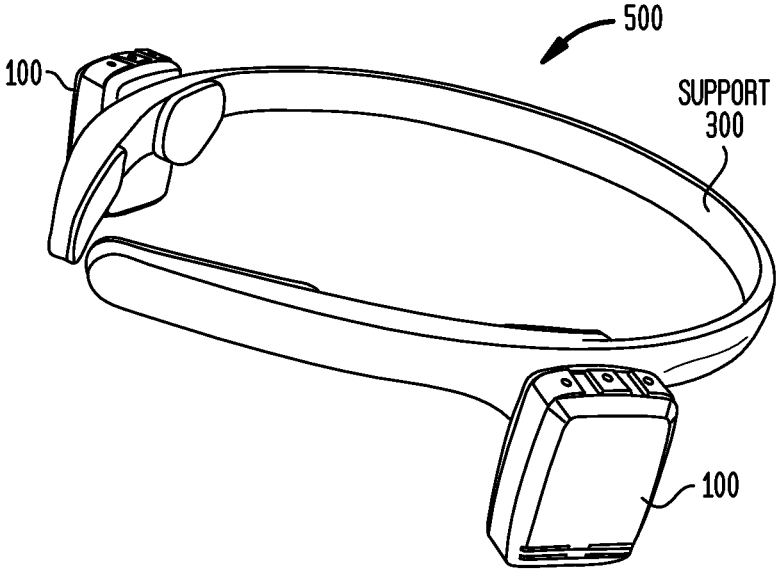
FIG. 5 depicts an isometric view of a hearing prosthesis using the support of FIG. 3A.

As may be seen in FIG. 4, skin interface portion 320 includes a bone conduction device attachment portion 330 configured to removably attach the coupling apparatus 140 of bone conduction device 100 to the support 300. FIG. 5 depicts bone conduction devices 100 attached to support 300 at the bone conduction device attachment portions 330. While the embodiment depicted in FIG. 4 will be described in terms of the bone conduction device attachment portion 330 being part of the skin interface portion 320, alternate embodiments may be practiced where the bone conduction device attachment portion 330 is a separate component (i.e., it is not part of the skin interface portion 320).

It is noted that while the bone conduction device attachment portion 330 is depicted as a separate structure relative to the elongated structure 310 (e.g., the structure of attachment portion 330 may be interference fitted or screw fitted, etc., into a bore into elongated structure 310) in other embodiments, bone conduction device attachment portion 330 may be part of the elongated structure 310 (e.g., it may be machined directly into metal or plastic or otherwise formed into the metal or plastic of the elongated structure 310).

An exemplary bone conduction device attachment portion 330 corresponds to, at least in part, the receptacle portion of a percutaneous abutment utilized in a percutaneous bone conduction implant. In an exemplary embodiment, bone conduction device attachment portion 330 is configured to enable removable attachment to the coupling in a manner substantially the same as that taught by and/or as would be understood to be a variation consistent with, the teachings of U.S. patent application Ser. Nos. 12/177,091 and/or 12/167,796 and/or 12/167,851 assigned to Cochlear Limited. By way of example, bone conduction device attachment portion 330 may enable snap-coupling/decoupling to/from a bone conduction device, magnetic coupling/decoupling to/from a bone conduction device, etc. In some embodiments, bone conduction device attachment portion 330 may correspond to any type of attachment portion that will permit a bone conduction device to be attached and/or detached to/from the support 300.

With respect to the embodiment depicted in FIG. 4, bone conduction device attachment portion 330 may function in a manner substantially the same as a percutaneous abutment utilized in a percutaneous bone conduction implant. The bone conduction device attachment portion 330 may have a geometry, at least with respect to the receptacle portion of the bone conduction device attachment portion 330, substantially similar to (including the same as) that of an abutment of a percutaneous bone conduction hearing prosthesis. This is the case, for example, with respect to the transmission of vibrations from the bone conduction device 100 into the support 300 via connection of the bone conduction device 100 to the bone conduction device attachment portion 330. Additional features of the functionality of the bone conduction device attachment portion 330 will be described below.

In the embodiments of FIGS. 3A-C, the support 300 is used to support a bone conduction device so that output from a medical device, such as, for example, vibratory waves (also referred to herein as vibrations) may be directed into the skin (through, for example, the skin interface portions). As will be detailed further below, the support may be used to transmit other types of output generated by a device supported by the support. Such output may include electromagnetic waves, waves of a magnetic inductance field, etc. It is noted that in some embodiments, transmission of the aforementioned waves is performed where the path of wave transmission follows a path comprised substantially entirely of (including entirely of) physical contact between the support and/or or the device generating the support and the skin (which includes hair interposed between the skin) This as contrasted to, for example, speaker head phones which rely on air transmission to transmit sound to the outer ear.

Any device, system or method that will permit a bone conduction device as detailed herein and in variations thereof to be attached to the support 300 so as to permit embodiments detailed herein and variations thereof to be practiced may be utilized in some embodiments.

In an exemplary embodiment, the support 300 corresponds to a headset configured such that the center of gravity of the headset, during normal use, with and/or without bone conduction devices attached thereto, is located behind and, with respect to a vertical direction, at least one of about level with or below a location where vibrations transmitted from a bone conduction device supported by the headset are transmitted into skin of the recipient where the skin covers the mastoid bone behind an ear canal of the recipient. Such an exemplary support is depicted in FIG. 3C, where center of gravity 370 is located as depicted.

FIG. 5 depicts bone conduction devices 100 removably attached to bone conduction device support 300, thereby forming a bone conduction device, herein prosthesis 500. As may be seen, two (2) bone conduction devices 100 are attached at locations on the support 300 such that the bone conduction devices 100 are located at substantially symmetrical locations. By substantially symmetrical, it is meant symmetrical with respect to a plane that bisects the device 300 through about the center of the segmented circle shape of the elongated structure 310 such that symmetrical portions of the elongated structure 310 would result. It is noted that while the support 300 described herein includes two bone conduction device attachment portions 330 for respective attachment to two bone conduction devices 100, other embodiments may only include one or may include three or more bone conduction device attachment portions. Further while the two bone conduction device attachment portions 330 are presented such that they are positioned at symmetrical locations, in other embodiments the bone conduction device attachment portions 330 may not be so symmetrically positioned. In the same vein, while the skin interface portions 320 described herein are presented as being symmetrical, in other embodiments, skin interface portion 320 may not be symmetrical. Still further, while two skin interface portion 320 have been described as being included in the support 300, other embodiments may include only one skin interface portion 320 or may include three or more skin interface portions 320.

The relationship between skin interface portions 320 and bone conduction devices 100 will now be described. In the embodiment of FIGS. 3A to 5, the skin interface portions 320 are configured to transfer vibrations generated from the bone conduction devices from the respective bone conduction devices 100 in closest proximity thereto, into the support 300 and then into the skin of the recipient, after which those vibrations are transferred from the skin of the recipient into the mastoid bone of the recipient such that a hearing percept may be evoked as in a manner analogous to that which may be evoked via the percutaneous bone conduction device detailed above with respect to FIG. 1 (except that skin is interposed between the mechanical path from the bone conduction device and the mastoid bone). Accordingly, in some embodiments, the clamping force supplied by the support 300 reacted through skin interface portions 320 in contact with the skin of the recipient is such that an effective amount of the vibrations generated by the bone conduction devices is transferred from the support 300 into the skin, the effective amount being sufficient to evoke the hearing percept.

The embodiments of FIGS. 3A to 5 are such that the bone conduction device attachment portions 330, and thus the bone conduction devices 100 when attached to support 300, are aligned/substantially aligned with the skin interface portions 320 and/or the distance between the bone conduction device attachment portions 330 and the skin interface portions 320 is a minimum/substantially a minimum. In other embodiments, the bone conduction device attachment portions 330 may be offset from the skin interface portions 320. This may be the case for one or two or three or more of the bone conduction device attachment portions 330 relative to the skin interface portions 320. In some embodiments, any location of the bone conduction device attachment portions 330 relative to the skin interface portions 320 may be utilized such that in embodiments detailed herein and variations thereof may be practiced.

In an alternate embodiment, support 300 may be configured such that the support 300 does not include skin interface portions but instead the support 300 is configured to attach to bone conduction devices 100 to which separate skin interface portion(s) are attached thereto. That is, vibrations generated by the bone conduction devices 100, at least those utilized to produce the hearing percept, are not transferred through the support 300 as would be the case in the embodiment depicted in FIG. 5, but are instead transferred from the bone conduction device to those separate skin interface portions attached directly to the bone conduction device 100. Thus, support 300 might attach, for example, to the housing of the bone conduction devices without contacting the coupling apparatus 140/coupling 142. In an alternate embodiment, the support 300 may attach at the coupling apparatus 140, coupling 142, but may be vibrationally isolated therefrom. In such an embodiment, vibrations could travel through the coupling apparatus 140/coupling 142 and into the separate skin interface portions attached to the couplings 142, passing by the support 300. An exemplary embodiment of the separate skin interface portion may correspond to module 620 when removed from support 600, described further below.

Accordingly, in some embodiments, support 300 is a support configured such that the vibrations generated by bone conduction devices 100 are transferred into the skin of the recipient at locations behind the ear canal of the recipient, where the skin covers the mastoid bone, regardless of whether a substantial amount (including any) of the vibrations generated by the bone conduction devices 100 travel through the support.

Still, with regard to the embodiment of FIGS. 3A to 5, in an exemplary embodiment, by way of example only and not by way of limitation, vibrations are generated from the respective bone conduction devices 100 which are transferred into the support 300 via the bone conduction device attachment portions 330. The vibrations then travel from the bone conduction device attachment portions 330 into structure of the support (e.g., into the skin interface portions 320). Again, embodiments of the support 300 may be such that the bone conduction devices 100 are offset from the skin interface portions such that the vibrations are transmitted through at least a portion of the structure 310 of the support 300 in the axial direction (i.e., paralleling the circumference of the structure 310). The vibrations travel from the skin interface portions 320 into the skin of the recipient, and then into the mastoid bone of the recipient. The vibrations then travel from the mastoid bone of the recipient directly to and/or through other tissue, to the cochlea of the recipient to evoke a hearing percept in the recipient.

It is further noted that the aforementioned vibration path may also include vibrations traveling through a skin penetrating abutment connected to a bone fixture implanted into the mastoid bone and/or into a bone fixture or a plate implanted beneath the skin of the recipient at the mastoid bone. Such a scenario may exist, for example, where an abutment is being "rested" and vibrations travel through the skin parallel to the mastoid bone and into the abutment. Such a scenario may also exist in an embodiment where the support 300 is used with a passive transcutaneous bone conduction device such as that disclosed in U.S. patent application Ser. No. 13/114,633. In such an exemplary embodiment, skin interface portions may be configured to transfer vibrations from the skin interface portions to the implantable component 350 of that application so as to evoke a hearing percept as disclosed therein. In this regard, in an exemplary embodiment, support 300 functions to support an external device 340 as disclosed therein proximate the implantable component 350. In this regard, support 300 may be further used to support an external device 440 at skin behind the ear canal and covering the mastoid bone as detailed in U.S. patent application Ser. No. 13/114,633 to achieve the hearing percept functionality detailed in that application.

Positioning of the skin interface portions at skin behind the ear canal and covering the mastoid bone will now be described with respect to embodiments that permit adjustment of the skin interface portions relative to other portions of the support.

Figure 6:
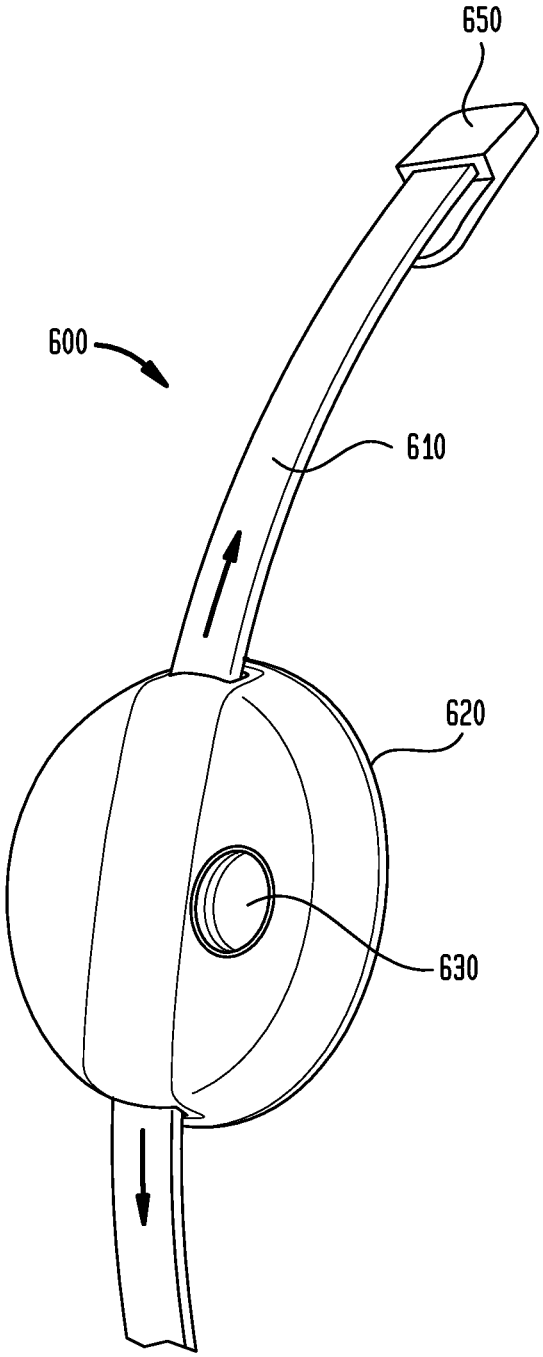
FIG. 6 depicts an isometric view of a modular skin interface portion usable with some embodiments of the support detailed herein.

FIG. 6 depicts an alternate embodiment of a bone conduction device support. Specifically, FIG. 6 depicts a portion of a bone conduction device support 600 that includes a modularized skin interface portion 620 that is configured to be controllably moved relative to elongated structure 610 as will now be described.

In the embodiment depicted in FIG. 6, elongated structure 610 is an elongated piece of resiliently flexible metal having a substantially rectangular cross section lying on a plane normal to the direction of elongation of the structure 610. Module 620 includes a skin interface portion and a bone conduction device attachment portion 630. In an exemplary embodiment, module 620 may structurally correspond to the portions identified within the 320 bracket depicted in FIG. 4. Accordingly, the skin interface portion of module 620 may correspond to or may be a variation thereof of those described herein (e.g., it may include an adhesive layer as detailed above) and bone conduction device attachment portion 630 may correspond to bone conduction device attachment portion 330 detailed above and/or variations thereof. Support 600 is configured to permit controlled adjustment of a location of module 620 along the length of the elongated structure 610. In the exemplary embodiment of FIG. 6, support 600 is configured such that a friction fit and/or a positive interference fit is established between structure 610 and module 620. These fits enable module 620, and thus the skin interface portion thereof, to slide along the elongated structure 610 upon application of a sufficient force to module 620 to overcome the respective friction fit or interference fit.

By friction fit, it is meant that a diameter of the module 620 at surfaces of the module 620 that interface with structure 610, in a relaxed state (e.g., not in contact with structure 610), are less than respective dimensions of surfaces of the elongated structure 610 that interface with module 620, in a relaxed state (e.g., not in contact with module 620), and/or visa-versa. Thus, a compressive force is applied by the module 620 to the structure 610 and a tensile force is applied by the structure 610 to the module 620. These forces are sufficient to generate sufficient friction to hold the module 620 in place relative to the structure 610 when a minimal amount of force is applied to module 620 relative to structure 610, but will permit module 620 to move relative to structure 610 upon application of a sufficient force such as may be applied by the hands of a user of bone conduction device support 600. (Some human factors issues relating to the bone conduction device supports detailed herein will be described in further detail below.)

By positive interference fit, it is meant a fit where a portion of module 620 or a component of module 620 is located within a general outer profile of elongated structure 610, or vice-versa, as will be described in greater detail with respect to the embodiment of FIG. 7A below.

An exemplary embodiment of a positive interference fit may include a ratchet mechanism. An exemplary ratchet mechanism that may be used with module 620 includes an elastically deformable tooth that is configured to extend into one of a plurality of grooves located on the outer or inner surface (relative to the head of the recipient) of structure 610. This tooth is of sufficient rigidity to ensure that the module 620 remains fixed in a given location along the structure 610 under the application of a minimal force to module 620, but upon the application of sufficient force to module 620, the tooth elastically deforms (or a support of the tooth elastically deforms) to permit the tooth to be removed from the given groove in structure 610, thereby permitting module 620 to be moved along structure 610 to a desired location where the tooth fits into a new groove. The force required to deform the tooth (or the support) is such that the module 620 will remain at a desired location along structure 610 until the recipient or other user of the support 600 affirmatively attempts to change the location of module 620 relative to structure 610.

In an alternate embodiment, a positive interference includes, for example, a bolt supported by module 620 that may be screwed into a hole of a series of holes in structure 610, or visa versa. In this regard, an alternate embodiment of a friction fit includes a bolt supported by module 620 that may be screwed down onto structure 610 with a sufficient force to prevent module 620 from sliding relative to structure 610. By unscrewing the bolt, the friction created by the friction fit may be adjusted so that the module 620 may slide relative to the structure 610.

Any device, system or method which will permit module 620, and thus skin interface portion, of the bone conduction device support to be adjusted in accordance with the embodiments herein and variations thereof may be used in some embodiments. It is noted that this is also the case with respect to other portions of the support that move relative to one another, as detailed herein and variations thereof.

As may be seen, the embodiment of FIG. 6 includes a foam cushion 650 located at the end of elongated structure 610. It is noted that while FIG. 6 depicts a portion of one side of a support 600, the configuration depicted in FIG. 6 may be also found on the other side of the exemplary support 600. However, in other embodiments, the configuration in FIG. 6 may be unique to one side of the support 600, the other side having a module 620 and/or a skin interface portion 320 being fixed relative to a given location with respect to structure 610. Alternatively or in addition to this, the other side of support 600 may not have a skin interface portion/ may have a different skin interface portion from that on the other side and/or may not have a module 620.

Figure 7A:
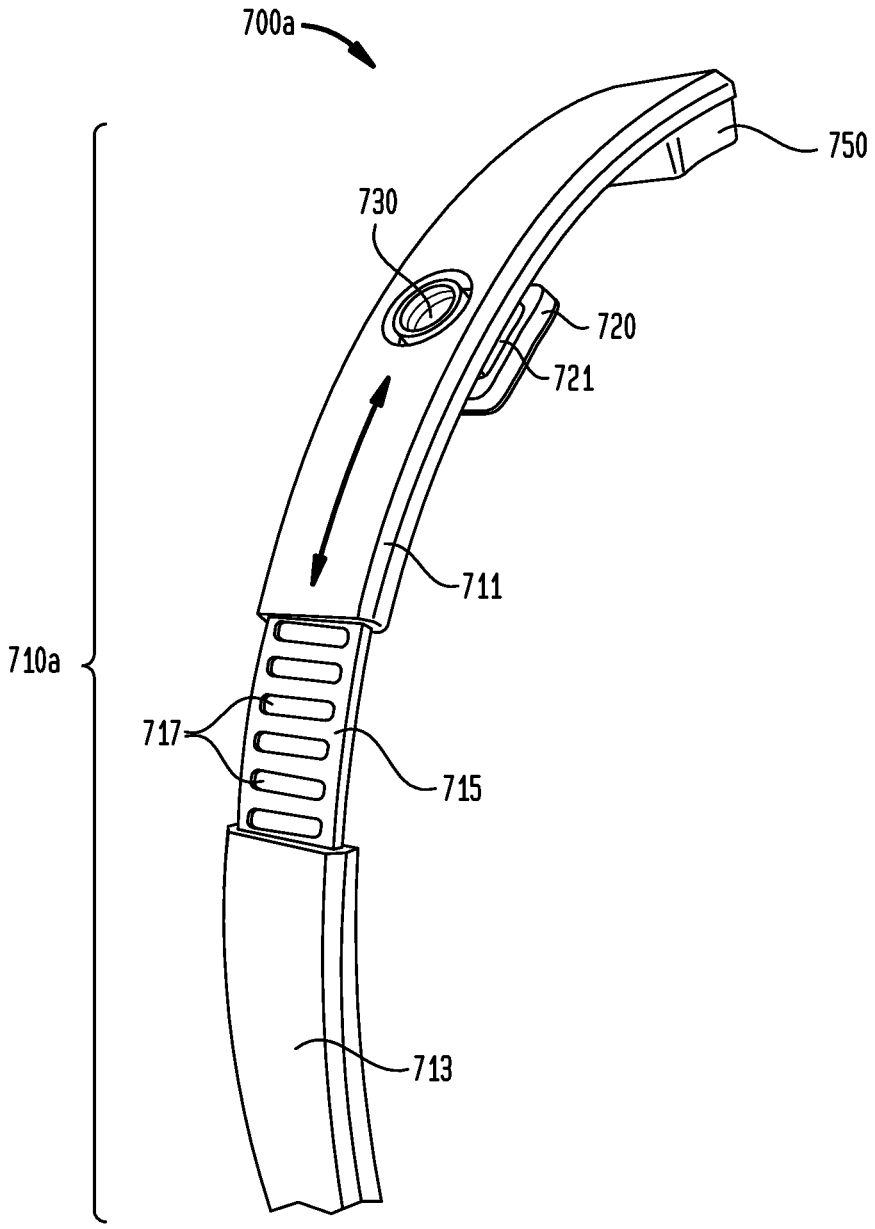
FIG. 7A depicts an alternate embodiment of a support in which structure providing a clamping force on the recipient includes a plurality of substructures.

FIG. 7A depicts a portion of an exemplary embodiment of a bone conduction device support 700*a* where the clamping force applied to the recipient's head is established by a structure comprising a plurality of sub-structures. As may be seen, support 700 includes structure 710*a*, a portion of which is depicted in FIG. 7A, that in turn includes substructure 711 and substructure 713. Substructure 711 and substructure 713 have cross-sectional configurations, on planes normal to the direction of extension of structure 710*a*, that are substantially identical in configuration to each other.

Substructure 711 and substructure 713 are connected to one another via substructure 715. Substructure 715 has overall outer diameters which are less than respective diameters of substructure 711 and 713. As may be seen, substructure 715 includes a plurality of grooves 717 that are located in substructure 715. The embodiment depicted in FIG. 7A is an embodiment where substructure 715 is fixedly mounted to substructure 711 and substructure 713 telescopes with respect to substructure 715, thus permitting the location of substructure 711 to be varied relative to substructure 713. In this regard, substructure 715 is a male component that extends into substructure 713, which corresponds to a female component. It is noted that while the embodiment of FIG. 7A includes two telescoping sections (one of which is not shown), embodiments may be practiced where there is only a single telescoping section (e.g., positioned such that it is located about the back of the head or neck of the recipient) or where there are three or more telescoping sections. Such embodiments may have a sub-structure that telescopes into another sub-structure which further telescopes into yet another sub-structure, and so on.

The position of substructure 713, relative to substructure 715 and thus substructure 711, is maintained via a positive interference fit in the form of a ratchet system. Grooves 717 of substructure 715 permit a tooth or a plurality of teeth (not shown) attached to substructure 713 to elastically fit into those grooves, thereby maintaining a position of substructure 711 relative to substructure 713 while also permitting the location of substructure 711 to be varied with respect to that of substructure 713 in accordance with the teachings above with respect to an interference fit. In an exemplary embodiment, a recipient or other user of the support 700*a* holds substructure 713 in one hand and holds substructure 711 in his or her other hand and applies a compressive force and/or a tensile force to the structure 700*a* to change the position of substructure 711 to move it towards or away from, respectively, substructure 713.

It is noted that in an alternate embodiment, substructure 715 could be originally connected to substructure 713 and substructure 711 could telescope with respect to substructure 715, or both substructure 711 and substructure 713 could telescope with respect to substructure 715. Any device, system or method that will permit the location of substructure 711 to be changed relative to substructure 713, or vice versa, while also permitting the locations of those structures to be maintained as detailed herein and variations thereof, may be used in some embodiments.

From FIG. 7A, it can be understood that moving the position of substructure 711 changes the position of skin interface portion 720 and pad 750. Thus, the position of skin interface portion 720 relative to the recipient may be adjusted such that the position of skin interface portion 720 will correspond to a location behind the ear canal of the recipient on skin covering the mastoid bone of the recipient. In the embodiment of FIG. 7A, skin interface portion 720 may be modularized as detailed herein and variations thereof, with element 721 permitting the modularized skin interface portion 720 to be offset from the clamping structure of the bone conduction device support 700*a*, as shown.

The embodiment of FIG. 7A depicts a support portion 721 located between substructure 711 and skin interface portion 720. Support portion 721 may be configured to vibrationally isolate skin interface portion 720 from the remainder of the support 700*a*. In an exemplary embodiment, bone conduction device attachment portion 730 is located in skin interface portion 720 and is not connected to substructure 711 and support portion 721. For example, a bore may extend through substructure 711 and through support portion 721 to provide clearance between the coupling apparatus 140 of bone conduction device 100.

In an exemplary embodiment applicable to all embodiments detailed herein and variations thereof, support portion 721 permits the distance between skin interface portion 720 and the rest of the structure of support 700*a* to be controllably adjusted. Thus, groove 717 of the interference fit permit axial adjustment of the location of the skin interface portion 720 while support portion 721 permits the radial adjustment of the location of the skin interface portion 721. In the embodiments depicted in FIG. 7A, support portion 721 may include a screw type mechanism that permits skin interface portion 720 to be screwed inward towards substructure 711 or outward from substructure 711 thereby changing the distance between skin interface portion 720 and substructure 711. Other embodiments may use other devices, such as, for example, a rack and pinion system to change the distance of skin interface portion 720 relative to substructure 711. Any device, system or method that may be utilized to change the radial distance of skin interface portion 720 relative to substructure 711 may be used to practice some embodiments herein and variations thereof.

It is noted that in embodiments where the skin interface portion and/or other components of the support are adjustable, markings may be included on the support that indicate the extent of adjustment from a baseline. For example, with respect to FIG. 6, element 610 may include markings to indicate the position of module 620. Still further by example, with respect to FIG. 7A, grooves 717 may be marked so as to indicate position of substructure 711 and/or substructure 713 relative to substructure 715. Such an embodiment may have utility in the event that a recipient accidently adjusts the position of the module 620 or substructure 713 or 711, thus permitting the recipient to reposition the module or substructure.

Figure 7B:
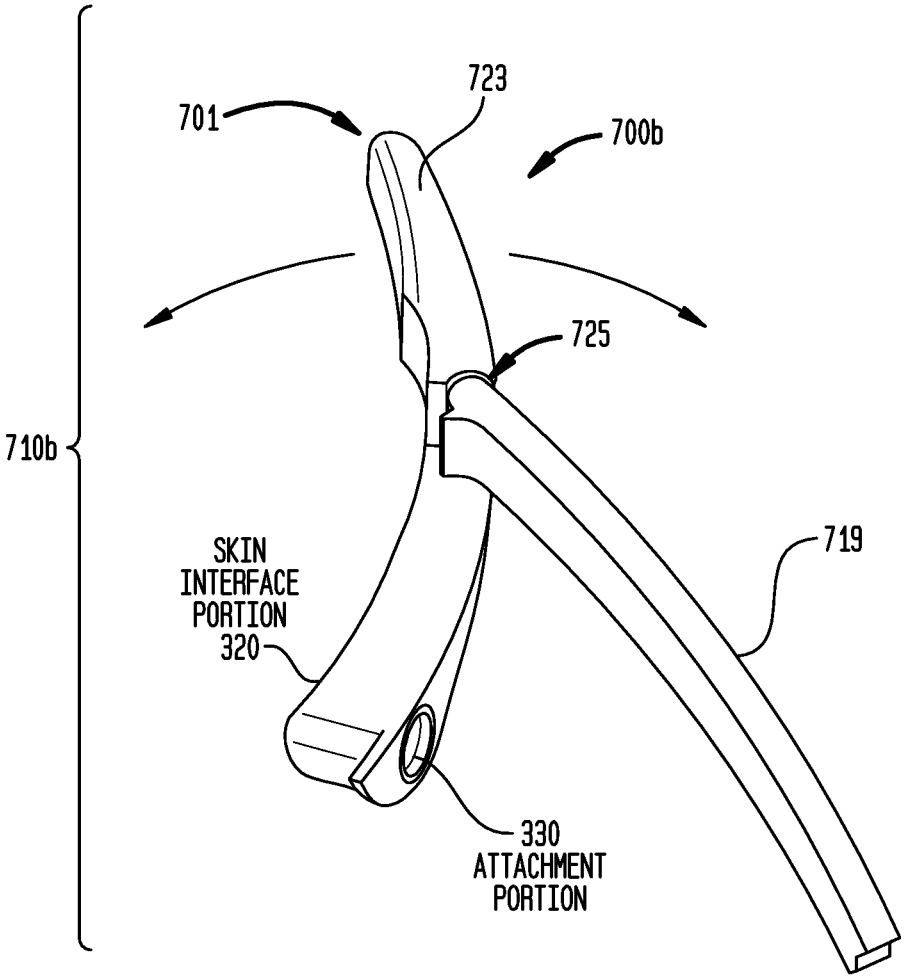

FIG. 7B depicts another embodiment of a bone conduction device support 700*b*. Particularly bone conduction device support 700*b* includes a structure, a portion of which is shown in FIG. 7B as structure 710*b*, that includes substructure 719 (again a portion of which is shown in FIG. 7B) and substructure 723. Substructure 723 articulates with respect to substructure 719. Particularly, hinge 725 permits substructure 723 to articulate relative to substructure 719 and/or visa-versa. Hinge 725 may be in the form of a barrel hinge, a pivot hinge, a piano hinge or any other type of hinge. The hinge pin of these respective hinges may be fixed to substructure 723 or substructure 719 or both in the case of a multi-hinge pin hinge 725. In an alternate embodiment, hinge 725 is established by making a portion that is integral to substructure 723 and/or substructure 719 more elastically deformable than other portions of substructure 723 and/or substructure 719. Alternatively, the hinge portion 725 may simply be a portion that is as elastically deformable as the other portions, and basic human factors dictate that this portion is the portion that will hinge. Any device, system or method that will permit substructure 723 to articulate with respect to substructure 719 may be practiced with at least some embodiments detailed herein and variations thereof.

In an embodiment utilizing the articulating substructure 723, the location of skin interface portion 320 and an end 701 of substructure 723, relative to the rest of the support, 700*b*, may be changed to better conform to the head of a recipient relative to the conformance obtained without the articulating ability of the substructures. While the embodiment depicted in FIG. 7B depicts a substructure 723 that articulates in the general plane on which the structure of the support extends, other embodiments may permit substructure 723 to articulate in and out of that plane, alternatively or in addition to the depicted articulation. It will be seen from FIG. 7B, in some embodiments, substructure 723 can only articulate to a certain angle relative to substructure 719 because a portion of the bone conduction device 100 attached at attachment point 330 may contact substructure 719. In this regard, the articulation depicted in FIG. 7B may be considered exaggerated and thus not to scale in some embodiments. However in other embodiments the location of bone conduction device attachment portion 330 may be such that there is clearance between the bone conduction device 100 and the rest of the Support 700*b*.

In an exemplary embodiment of the bone conduction device support 700*b* of FIG. 7B and/or variations thereof, substructure 723 and its opposite substructure on the other side of the bone conduction device 700*b* are utilized to transmit the clamping force generated by the support 700*b* to the head of the recipient either at the location of the skin interface portion 320 substantially entirely (including entirely) or at the skin interface portion 320 and the end 701 of substructure 723 (or to a pad that may be located at the end of substructure 701). Alternatively, this clamping force may be distributed at points between the end 701 and the location of skin interface portion 320.

It is noted that in some embodiments, any of the features of the various supports detailed herein may be combined with any other of the features of the various supports detailed herein. By way of example, a support may include the telescoping feature of the embodiment of FIG. 7A along with the hinge feature of the embodiment of FIG. 7B.

As noted above, embodiments detailed herein and variations thereof may be applicable to support devices for other types of hearing prostheses and/or other types of medical devices. By way of example and not by way of limitation, one or more of all of the supports detailed herein and/or variations thereof may be applicable to support an external component of a cochlear implant and or an external component of an active transcutaneous bone conduction device. Such an external component may include a telecoil. The support may be configured to position the telecoil at a location behind the ear canal of the recipient on skin of the recipient covering the mastoid bone at a location proximate to an implantable component of the cochlear implant. This implantable component/a portion of the implantable component may include a telecoil as well. Thus, the supports detailed herein and/or variations thereof may be utilized to position an external telecoil proximate to and in alignment with the implanted telecoil. Such an embodiment may be utilized, by way of example, in a scenario where the implanted magnet is unfeasible and/or where an implanted magnet has otherwise failed for a given reason, where the implanted magnet would otherwise be used to align and/or hold the external component against the skin of the recipient.

Embodiments of the supports detailed herein and/or variations thereof may be utilized in instances where recipients are evaluating bone conduction hearing prosthesis, either in a unilateral and/or a bilateral and/or multilateral configuration. Such supports may be utilized in the case of recipients awaiting surgery for a percutaneous bone conduction implant and/or a transcutaneous bone conduction implant. Such supports may be utilized by way of example for children whose mastoid bones and/or other bones are not of sufficient thickness and/or sufficient strength to receive the implanted portion of a bone conduction prostheses. Indeed in an exemplary embodiment the supports detailed herein and/or variations thereof may be utilized with adults or children who have developed an infection with respect to the implanted portion of the bone conduction device and/or who are simply in need of resting the implant abutment.

Some of the embodiments detailed herein and variations thereof may be utilized to provide a bilateral bone conduction hearing prosthesis. Thus, such a support may be utilized to test (evaluate) a bilateral hearing prosthesis. Such may be done, in some embodiments, without any additional parts or connectors to be added to a given support. In this regard, while the supports detailed herein have been detailed in terms of having the ability to connect two or more bone conduction devices thereto (e.g., permitting the establishment of a bilateral bone conduction hearing prosthesis), it is noted that in some embodiments, even though the supports have two or more bone conduction device attachment portions, such supports may be utilized with only one bone conduction device attached thereto thus permitting the same support to be utilized in a unilateral configuration and/or a bilateral configuration.

An embodiment of the supports detailed herein and variations thereof are sized and dimensioned and otherwise configured to permit use of a given support on a child and an adult without any specific adjustments and/or any clinical measurement of the recipient's head. That is, a given support may be issued to a recipient irrespective of whether that recipient is a child or an adult (i.e., irrespective of the size of the child's head/development of the organs of the recipient's head), where the recipient himself or herself or a semi-trained or even untrained person may sufficiently adjust the support so as to obtain a sufficient efficacy of the hearing prosthesis vis-à-vis a hearing percept obtained by a bone conduction device. That is, because the supports detailed herein and variations thereof permit adjustment of the skin interface location and/or permit the entire system to be moved relative to the recipient's head so as to position a given skin interface portion at a desired location, specific training and/or skills may not be needed to utilize some embodiments. Indeed, in some embodiments, a trial and error approach can be recommended for recipients, because the adjustments to the support 300 are relatively easily made compared to other support systems for other bone conduction hearing prostheses.

At least some embodiments of the supports detailed herein and variations thereof are sized and dimensioned and otherwise configured to conform to the head of a statistically average (mean or median) human being in a given population. In an exemplary embodiment, there are supports detailed herein and variations thereof that are sized and dimensioned and otherwise configured to conform to the head of a statistically average sized human as well as the head of a human being falling within one-half of a standard deviation larger and/or smaller from the statistically average sized human. In yet other embodiments, such supports are sized and dimensioned and otherwise configured to conform to the head of a statistically average sized human as well as the head of a human having a head size falling within one standard deviation larger and/or smaller than the average head size.

In exemplary embodiments, there is a support as detailed herein and/or variations thereof that is sized, dimensioned, and/or otherwise configured to conform to a statistically average size head of a human being of a given population and a head larger and/or smaller than that that falls within about 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9 and 3.0 and/or more standard deviations from the statistically sized average, without additional parts and/or without the need to remove parts (i.e., only adjustments are made as detailed herein).

With respect to a given population, such a population may include, in some embodiments, the population of the entire world. In other embodiments, it may be directed to an ethnic populace such as for example Caucasians, Mongoloids and/or Negroids. In yet other embodiments, the aforementioned population may be limited to a geographic region such as North America, South America, Asia, Europe, Africa and/or Australia. In yet other embodiments, the population may be limited to citizens and/or residents of specific countries, such as the United States, Australia, Canada, the United Kingdom, France, Germany, Spain, Sweden, Italy, China, India, Japan, Mexico, etc. The population may be limited to adults, may be limited to children, may be limited to adolescents or may be limited to the combination thereof (e.g. adolescents and adults, children and adolescents). In some embodiments, the population may be limited to humans above a certain age, such as, for example above one year old, above 18 months old, above 2 years old, above 2.5 years old, above 3 years old, above 3.5 years old, above 4 years old, above 4.5 years old, above 5 years old, above 5.5 years old, above 6 years old, above 6.5 years old, above 7 years old, above 7.5 years old, above 8 years old, above 9 years old, above 10 years old, above 11 years old, above 12 years old, above 13 years old, above 14 years old, above 15 years old, and or above 16 years old.

It is noted that the just described examples of populations, in some embodiments, are combined in any variety. By way of example, an exemplary population may include Caucasians having U.S. citizenship that are older than 6 years old. It is also noted that the aforementioned populations may be bifurcated between male and female and the above mentioned populations may be further bifurcated into subpopulations (e.g. non-Hispanic Caucasians, Hispanic Caucasians). Any population group may be utilized in some embodiments detailed herein.

At least some of the embodiments of the supports detailed herein and variations thereof are configured to provide a clamping force to one or more of the aforementioned populations and/or combinations and/or sub-combinations thereof of recipients such that the support retained relative to the head of the recipient is retained at substantially the same place on the recipient being subjected to an acceleration in the horizontal and/or vertical direction (up or down) and/or in vectors between such that the medical device supported by the support maintains efficacy. By way of example only and not by way of limitation, an exemplary support may retain itself (and the medical device it supports) to the head of the recipient without substantially moving (where substantially moving results in a significant degradation of the performance of the hearing prosthesis of which the support is a part) when subjected to an upward and/or downward and/or horizontal forward and/or horizontal backward acceleration that corresponds to 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, 2.0, 2.5, 3.0, 3.5, 4.0, 5.0, 6.0, 7.0, 8.0, 9.0 and/or 10.0 G-forces, at least some of which may be experienced in the event of the recipient standing from a seated position and/or visa-versa, the recipient walking and/or running up or down stairs. Such G-forces may be experienced, for example, where the recipient is subjected to even greater accelerations, such as may be obtained in the event of the recipient jumping up or down (which may be experienced while running, playing basketball, jumping from a jungle gym, etc.).

At least in some embodiments of the present invention, where the support arches around the back of the recipient's head passing through a location, in the vertical direction, between the head and the shoulders of the recipients/in the neck region (vertically speaking) of the recipient, improved cosmetic results are obtained vis-à-vis supports that arch about the top of the head. For example, because the support is not worn across the entire head, such as in the case with headphones and the like, the support is less visible than other types of supports used for other devices and or devices detailed herein. In an exemplary embodiment, the supports detailed herein and variations thereof may be configured such that the support maintains a position of the device supported thereon to permit efficacious functionality of the device vis-à-vis the recipient without a component extending about a top of the head. Such an embodiment may be configured to maintain its position relative to the recipient after the recipient is subjected to 2G-forces in the vertical direction. It is noted that the aforementioned performance features, vis-à-vis retention when subjected to G-forces, are achieved without ancillary support of the support (e.g., the recipient is not holding the support to his or her head, etc.). By normal use, it is meant use as prescribed, for example, by an audiologist, a surgeon, the manufacturer of the device as approved by a major underwriting entity (e.g., Underwriters Laboratory in the U.S.), etc.

It is noted that in the embodiments of the supports detailed herein having adjustable components such that, for example, the location of the skin interface portion may be adjusted relative to the rest of the support, such adjustment permits at least in some embodiments the supports to be applicable to the above mentioned populations without reconstructing the support/adding components/removing components from the support. Thus, in an exemplary embodiment there is a self-contained support that may be issued to a wide range of populations of recipients without medical measurement of the recipient's head. That is, an exact size of a recipient's head need not be determined.

In some embodiments of the supports detailed herein and variations thereof, sides of the support may be labeled to indicate which sides of the support should be positioned relative to a side of a recipient. Such labeling may be in words and/or in symbols (e.g., L, R, sides of the head depicted in a pictorial, etc.).

In some embodiments, the supports detailed herein and variations thereof are configured to be single use products and/or disposable products. That is, at least some supports detailed herein and variations thereof are configured such that they are to be disposed of after utilization of the support by a recipient is completed. That is, such supports need not be shared between different recipients. Such an exemplary embodiment reduces the need for enhanced cleaning of such supports as might otherwise be the case for shared supports.

Figure 8:
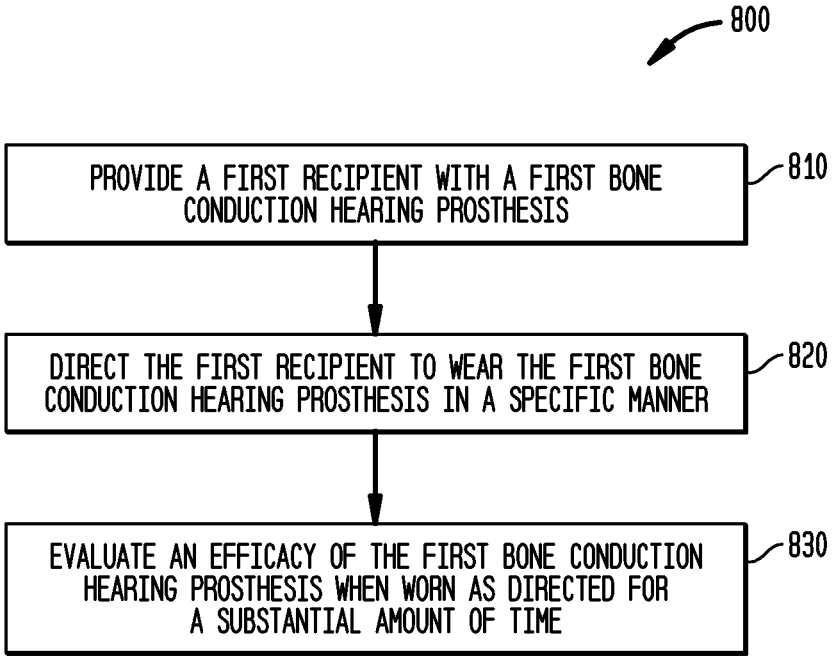
FIG. 8 presents an exemplary flowchart for an exemplary method according to an embodiment.

FIG. 8 presents an exemplary flow chart 800 representing, by way of example only and not by way of limitation, an exemplary method of utilizing the supports detailed herein and variations thereof. At step 810, a practitioner in the bone conduction hearing prostheses arts (e.g., an audiologist, an audiological surgeon, a nurse, etc.) provides a recipient with a bone conduction hearing prosthesis including a support as detailed herein and variations thereof and one or more bone conduction devices supported thereby. It is noted that the term "providing" as used in this method includes both obtaining the prosthesis and directly giving the prosthesis to the recipient and enabling the recipient to obtain the prosthesis on his or her own (e.g., providing the recipient with a prescription for the prosthesis). At step 820, the practitioner directs the recipient to wear the first bone conduction hearing prosthesis during every day (normal) usage such the hearing prosthesis extends around a back of a head of the recipient without extending all the way in front of the head of the recipient and without extending all the way over a top of the head of the recipient. At step 830, the practitioner evaluates the efficacy of the hearing prosthesis after at least two days of the recipient wearing and using the hearing prosthesis for substantial portions of the two days as directed.

An exemplary method further includes repeating some or all of steps 810 for a number of different recipients, where the respective provided bone conduction device hearing prostheses are of a design that is duplicative. Further, in practicing such a method, such a method may include providing such hearing prostheses to recipients having different sized heads. By way of example, the recipients of a first group of, say, 10 recipients, may be adult males having heads with circumferences in a horizontal plane bisecting an opening of an ear canal of the recipient of a first value or more. Further by way of example, the recipients of a second group may be of, say, 10 recipients, may be child males having heads with circumferences in a horizontal plane bisecting an opening of an ear canal of the recipient of a second value or less, where the second value is about two-thirds the value of the first value. Because of at least some features as detailed herein and variations thereof of at least some embodiments of the supports detailed herein and variations thereof, the same hearing prosthesis may be provided to both children and adults of substantially different head sizes.

While various embodiments of the present invention have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. A prosthetic support, comprising:

a structure configured to apply a clamping force to a head of a recipient while extending about a back of at least one of a head or neck of the recipient such that output generated by a device supported by the structure is directed into skin of the recipient at a location behind an ear canal of the recipient that covers the temporal bone of the recipient, wherein the device is an operationally removable component removable from the structure, and the prosthetic support is configured to maintain the device completely away from contact with the recipient.

2. The prosthetic support of claim 1, wherein:

the structure is elastically flexibly biased such that the clamping force results from deformation of the structure due to interference of the structure with the head of the recipient relative to a geometry of the structure in a relaxed state.

3. The prosthetic support of claim 2, wherein:

the structure is generally "U" shaped, "C" shaped or segmented circle shaped in the relaxed state.

4. The prosthetic support of claim 1, further comprising:

a skin interface portion that is at least one of part of or directly attached to the structure, the skin interface portion being located on the support such that it abuts skin of the recipient at a location behind an ear canal of the recipient covering the temporal bone of the recipient when the clamping force is applied to the head of the recipient.

5. The prosthetic support of claim 4, wherein:

at least a substantial amount of the clamping force applied to the head of the recipient is applied through the skin interface portion.

6. The prosthetic support of claim 4, wherein:

the output includes vibrations generated by a bone conduction device;

the skin interface portion is configured to transcutaneously transmit the vibrations into the skin of the recipient, from which the vibrations enter the temporal bone of the recipient, in amounts to provoke a hearing percept in the recipient, the vibrations traveling through the skin interface portion.

7. The prosthetic support of claim 1, wherein:

the prosthetic support further comprises a device attachment portion attached to or part of the structure, wherein the device attachment portion is configured to enable the removable attachment of the device to the prosthetic support, wherein the device is a medical device; and the medical device is a bone conduction device including a coupling apparatus.

8. The prosthetic support of claim 7, wherein:

the attachment portion is configured to removably snap couple the coupling apparatus to the support.

9. The prosthetic support of claim 1, wherein the device is a bone conduction device that generates vibrations and the output includes the generated vibrations, the prosthetic support further comprising:

a skin interface portion that is part of or directly attached to the structure such that it abuts skin covering the temporal bone at a location behind an ear canal of the recipient, wherein a substantial amount of the clamping is applied via the skin interface portion, wherein the prosthetic support is configured to conduct the generated vibrations from the bone conduction device, through the skin interface portion and into the skin of the recipient, from which the vibrations enter the temporal bone of the recipient, in amounts to provoke a hearing percept in the recipient.

10. The prosthetic support of claim 9, further comprising:

a device attachment portion attached to or part of the structure, wherein the attachment portion is configured to enable the removable attachment of the bone conduction device to the prosthetic support, wherein the skin interface portion and the device attachment portion are part of a modular assembly movably attached to the structure.

11. The prosthetic support of claim 4, wherein:
the support is configured to enable a recipient to adjust a location of the skin interface portion relative to the structure.

12. The prosthetic support of claim 11, wherein:
the skin interface portion is part of a module that is releasably secured to a given location of the structure, the module including a device attachment portion configured to removably attach the device to the prosthetic support;
the support is configured to enable the module to be released from securement to the given location of the structure and moved to and releasably secured to another location of the structure, thereby enabling the recipient to adjust a location of the skin interface portion relative to the structure; and
the device is a medical device.

13. The prosthetic support of claim 4, wherein the structure comprises:
a first sub-structure on which the skin interface portion is mounted; and
a second-sub structure,
wherein the first sub-structure is configured to telescope towards and away from the second sub-structure to enable a location of the skin interface portion to be moved relative to the second sub-structure.

14. The prosthetic support of claim 4, wherein:
the device is a bone conduction device including a coupling apparatus; and
the skin interface portion comprises:
an attachment portion configured to attach the coupling apparatus of the bone conduction device to the skin interface portion;
a body portion configured to connect the skin interface portion to the structure; and
an adhesive portion configured to adhesively removably retain the skin interface portion to skin of the recipient.

15. A medical device, comprising:
the prosthetic support of claim 1; and
the device, wherein the device includes a telecoil,
wherein the clamping force is sufficient to hold the telecoil in proximity to the skin to place the telecoil into transcutaneous electromagnetic communication with an implanted medical device implanted beneath the skin of the recipient.

16. The prosthetic support of claim 1, wherein:
the device is a bone conduction device and the output includes vibrations generated by a bone conduction device;
the prosthetic support includes a skin interface portion that is at least one of part of or directly attached to the structure, the skin interface portion being located on the support such that it abuts skin of the recipient at the location when the clamping force is applied to the head of the recipient irrespective of the presence or absence of the device, the skin interface portion being configured to transcutaneously transmit the vibrations into the skin of the recipient, from which the vibrations enter the temporal bone of the recipient, in amounts to provoke a hearing percept in the recipient, the vibrations traveling through the skin interface portion; and
at least a substantial amount of the clamping force applied to the head of the recipient is applied through the skin interface portion.

17. The prosthetic support of claim 16, further comprising:
the device, wherein:
the device is removably attached to the prosthetic support.

18. The prosthetic support of claim 8, wherein:
the prosthetic support is configured such that the vibrations travel from the coupling apparatus of the bone conduction device to the prosthetic support and then to skin of the recipient at the location so that the vibrations enter the temporal bone of the recipient, in amounts to provoke a hearing percept in the recipient.

19. The prosthetic support of claim 7, wherein:
the device is removably attached to the prosthetic support at the attachment portion via the coupling apparatus of the device; and
the device is an operationally removable component of a percutaneous bone conduction device configured to attach to an abutment of a recipient extending through skin of the recipient using the same coupling apparatus that removably attaches the operationally removable component of the bone conduction device to the prosthetic support.

20. The prosthetic support of claim 1, wherein:
the device is an operationally removable component of a bone conduction device that is removably attached to the prosthetic support; and
prosthetic support is configured to maintain the device completely away from contact with the recipient such that all vibrations generated by the bone conduction device enter the prosthetic support.

21. The prosthetic support of claim 7, wherein:
the coupling apparatus is a coupling apparatus configured to attach to an abutment of a recipient extending through skin of the recipient.

22. The prosthetic support of claim 1, wherein:
the structure is configured such that the structure extends above a pinna at locations in front of the pinna when applying the clamping force against the head.

23. The prosthetic support of claim 10, wherein:
the device is removably attached to the modular assembly, and the device is an operationally removable component of a percutaneous bone conduction device.

24. The prosthetic support of claim 11, wherein:
the device is removably attached to the prosthetic support and the device is an operationally removable component of a percutaneous bone conduction device and maintained completely away from skin of the recipient.

25. The prosthetic support of claim 1, wherein:
the device is a bone conduction device; and
the prosthetic support is configured to maintain the device completely away from contact with the recipient such that all vibrations generated by the bone conduction device enter the prosthetic support.

26. A headset for a bone conduction device, comprising:
a headset configured to support at least one bone conduction device and configured to provide a clamping force reactive against a head of the recipient sufficient to transmit vibrations from the bone conduction device into skin of the recipient at a location where the skin covers the temporal bone behind an ear canal of the recipient,
wherein the headset is configured such that a center of gravity of the headset, during normal use, is located behind and, with respect to a vertical direction, at least one of about level with or below the location, and
wherein at least one of:
the headset is configured to snap couple to the bone conduction device supported by the headset such that vibrations travel through the snap coupling into the headset, which vibrations that travel into the headset evoke a hearing percept at the location; or the headset is configured to provide the clamping force reactive against the head of the recipient sufficient to transmit vibrations from the bone conduction device into skin of the recipient at the location if the bone conduction device was present when the bone conduction device is not attached to the headset.

27. The headset of claim 26, wherein:

the headset is configured to maintain a position of the headset, relative to the recipient, such that the vibrations are transmitted into the skin of the recipient without a component extending about a top of the head.

28. The headset of claim 27, wherein:

the headset is configured to maintain the position while the recipient is subjected to 2 G-forces in the vertical direction.

29. The headset of claim 26, wherein:

the headset is configured to snap couple to the bone conduction device supported by the headset such that vibrations travel through the snap coupling into the headset, which vibrations that travel into the headset evoke the hearing percept at the location.

30. The headset of claim 26, wherein:

the headset includes a structure configured to extend about a back of at least one of a head or neck of the recipient;

the headset is configured such that a first portion of the structure articulates relative to a second portion of the structure beyond that which is due to flexibility of the overall structure and/or the first portion of the structure and/or the second portion of the structure, wherein the bone conduction device is mounted to the first portion of the structure such that the bone conduction device is away from the second portion of the structure and moves in a one to one relationship with the first portion of the structure, wherein the first portion of the structure and the second portion of the structure extend in at least about a same plane as each other.

31. The headset of claim 26, wherein:

the headset is configured to substantially vibrationally isolate the headset from the vibrations.

32. The hearing prosthesis of claim 26, wherein:

the headset is a curved band having two free and opposite ends, wherein the ends of the band have a maximum outer diameter that is at least about no more than that of a location along the band that is at least about equidistant from the ends.

33. The headset of claim 26, further comprising:

a skin interface portion that is at least one of part of or directly attached to a structure that extends about the head of the recipient, the skin interface portion being located such that it abuts skin of the recipient at the location when the clamping force is applied to the head of the recipient, wherein at least a substantial amount of the clamping force applied to the head of the recipient is applied through the skin interface portion, and the skin interface portion includes a skin interface surface that is proud of an inner surface of the structure.

34. The headset of claim 26, wherein:

the headset is configured such that the headset extends above a pinna at locations in front of the pinna when applying the clamping force against the head.

35. The headset of claim 26, wherein:

the headset is configured to provide the clamping force reactive against a head of the recipient sufficient to transmit vibrations from the bone conduction device into skin of the recipient at the location if the bone conduction device was present when the bone conduction device is not attached to the headset.

36. A hearing prosthesis, comprising:

a bone conduction device; and means for supporting the bone conduction device such that vibrations from the bone conduction device are transferred into skin of a recipient of the bone conduction device covering the temporal bone at a location behind an ear canal of the recipient, wherein the means is completely external to the recipient, wherein the bone conduction device is removably attached to the means for supporting the bone conduction device, and the bone conduction device is an operationally removable component of a percutaneous bone conduction device snap coupled to the means for supporting the bone conduction device such that the vibrations travel through the snap coupling.

37. The hearing prosthesis of claim 36, wherein:

the bone conduction device includes means for coupling the bone conduction device to the means for supporting the bone conduction device and the means for supporting the bone conduction device includes means for coupling the means for supporting the bone conduction device to the means for coupling the bone conduction device of the bone conduction device.

38. A prosthetic support, comprising:

a structure configured to apply a clamping force to a head of a recipient while extending about a back of at least one of a head or neck of the recipient such that output generated by a device supported by the structure is directed into skin of the recipient at a location behind an ear canal of the recipient that covers the temporal bone of the recipient; and a device attachment portion attached to or part of the structure, wherein the attachment portion is configured to removably attach the device to the prosthetic support via coupling, wherein the device is a bone conduction vibrator, and wherein the prosthetic support is configured such that vibrations generated by the bone conduction vibrator to evoke a hearing percept are transmitted from the vibrator into the device attachment portion and thus into the prosthetic support and then from the prosthetic support into skin of the recipient, and thus the output includes vibrations generated by the bone conduction vibrator.

39. The prosthetic support of claim 38, further comprising:

a skin interface portion that is at least one of part of or directly attached to the structure, the skin interface portion being in vibrational communication with the device attachment portion and being located on the support such that it abuts skin of the recipient at the location when the clamping force is applied to the head of the recipient irrespective of the presence or absence of the device, the skin interface portion being configured to transcutaneously transmit the vibrations from the prosthetic support into the skin of the recipient, from which the vibrations enter the temporal bone of the recipient, in amounts to provoke a hearing percept in the recipient, the vibrations traveling through the skin interface portion; and at least a substantial amount of the clamping force applied to the head of the recipient is applied through the skin interface portion.

40. The prosthetic support of claim 39, wherein:

the skin interface portion and the device attachment portion are part of a modular assembly movably attached to the structure.

41. The prosthetic support of claim 40, wherein:

the device is a completely separate part from the modular assembly.

42. A prosthetic support, comprising:

a structure configured to apply a clamping force to a head of a recipient while extending about a back of at least one of a head or neck of the recipient such that output generated by a device supported by the structure is directed into skin of the recipient at a location behind an ear canal of the recipient that covers the temporal bone of the recipient, wherein the device is a bone conduction device, and the device is supported by the structure; and the structure is configured to apply the clamping force to the head of a recipient while extending about the back of at least one of the head or neck of the recipient such that output generated by a device supported by the structure is directed into skin of the recipient at the location while isolating the device from the clamping force.

* * * * *